US009420927B2

(12) United States Patent
Ventress et al.

(10) Patent No.: US 9,420,927 B2
(45) Date of Patent: Aug. 23, 2016

(54) VACUUM CLEANER TOOL

(71) Applicant: Dyson Technology Limited, Wiltshire (GB)

(72) Inventors: Sean Ventress, Bristol (GB); Brian McVeigh, Bristol (GB); Samuel Steven Cole, Swindon (GB); Peter David Gammack, Swindon (GB); James Dyson, Bristol (GB); Robert Streeter, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 0 days.

(21) Appl. No.: 14/618,743

(22) Filed: Feb. 10, 2015

(65) Prior Publication Data

US 2015/0223654 A1 Aug. 13, 2015

(30) Foreign Application Priority Data

Feb. 10, 2014 (GB) ..... 1402281.8

(51) Int. Cl.
*A47L 9/06* (2006.01)

(52) U.S. Cl.
CPC ..... *A47L 9/062* (2013.01); *A47L 9/0666* (2013.01); *A47L 9/0673* (2013.01)

(58) Field of Classification Search
CPC ..... A47L 9/062; A47L 9/0666; A47L 9/0673
USPC ..... 15/399, 400
IPC ..... A47L 9/06
See application file for complete search history.

(56) References Cited

U.S. PATENT DOCUMENTS

| | | | | |
|---|---|---|---|---|
| 921,669 | A | 5/1909 | Boegel et al. | |
| 1,033,016 | A | 7/1912 | Hope | |
| 1,633,598 | A | 6/1927 | McClatchie | |
| 1,663,365 | A | 3/1928 | Wise et al. | |
| 1,971,493 | A * | 8/1934 | Leathers | A47L 9/06 15/369 |
| 2,086,124 | A | 7/1937 | Ell | |
| 2,157,077 | A | 5/1939 | Kroenlein | |
| 2,703,903 | A | 3/1955 | Faith-Ell | |
| 3,072,951 | A | 1/1963 | Kelnhofer | |
| 5,440,782 | A | 8/1995 | Yamashita | |
| 5,678,279 | A | 10/1997 | Gühne et al. | |
| 5,722,112 | A | 3/1998 | Scanni et al. | |

(Continued)

FOREIGN PATENT DOCUMENTS

| | | |
|---|---|---|
| CH | 165488 | 11/1933 |
| DE | 689 460 | 3/1940 |

(Continued)

OTHER PUBLICATIONS

Search Report dated Jul. 30, 2014, directed to GB Application No. 1402281.8; 1 page.

(Continued)

*Primary Examiner* — David Redding
(74) *Attorney, Agent, or Firm* — Morrison & Foerster LLP

(57) ABSTRACT

A tool for a vacuum cleaner that includes a nozzle and a bristle assembly. An elongate suction opening is provided in a base of the nozzle. The bristle assembly is mounted within the nozzle and includes a carrier to which a strip of bristles is attached. The carrier pivots or flexes relative to the nozzle and has a pair of wings located on opposite sides of the bristles.

20 Claims, 11 Drawing Sheets

(56) References Cited

U.S. PATENT DOCUMENTS

| | | | | |
|---|---|---|---|---|
| 6,029,311 | A | 2/2000 | Scanni et al. | |
| 6,094,777 | A | 8/2000 | Windmeisser | |
| 2004/0139993 | A1 | 7/2004 | Grey | |
| 2010/0236017 | A1 | 9/2010 | Krebs | |
| 2010/0306959 | A1 * | 12/2010 | Follows | A46B 13/005 15/383 |
| 2015/0374185 | A1 | 12/2015 | Cole et al. | |
| 2015/0374186 | A1 | 12/2015 | Cole et al. | |

FOREIGN PATENT DOCUMENTS

| | | |
|---|---|---|
| DE | 950 233 | 10/1956 |
| DE | 1 503 919 | 11/1970 |
| DE | 203 13 203 | 11/2003 |
| EP | 0 264 625 | 4/1988 |
| EP | 0 786 228 | 7/1997 |
| EP | 1 832 214 | 9/2007 |
| FR | 1.102.148 | 10/1955 |
| FR | 1.584.025 | 12/1969 |
| GB | 519 | 0/1909 |
| GB | 185278 | 9/1922 |
| GB | 2 076 640 | 12/1981 |
| GB | 2 090 728 | 7/1982 |
| GB | 2 273 653 | 6/1994 |
| JP | 52-15872 | 2/1977 |
| JP | 56-17043 | 7/1979 |
| JP | 58-190960 | 12/1983 |
| JP | 62-37256 | 3/1987 |
| JP | 5-317226 | 12/1993 |
| JP | 3001242 | 8/1994 |
| JP | 6-343585 | 12/1994 |
| JP | 7-241 | 1/1995 |
| JP | 7-37014 | 7/1995 |
| JP | 8-228975 | 9/1996 |
| JP | 2001-54495 | 2/2001 |
| JP | 2004-237127 | 8/2004 |
| JP | 2010-22515 | 2/2010 |
| WO | WO-00/65979 | 11/2000 |
| WO | WO-03/001958 | 1/2003 |

OTHER PUBLICATIONS

International Search Report and Written Opinion mailed Jun. 5, 2015, directed to International Application No. PCT/GB2015/050232; 15 pages.

* cited by examiner

VACUUM CLEANER TOOL

REFERENCE TO RELATED APPLICATION

This application claims priority of United Kingdom Application No. 1402281.8, filed Feb. 10, 2014, the entire contents of which are incorporated herein by reference.

FIELD OF THE INVENTION

The present invention relates to a tool for a vacuum cleaner.

BACKGROUND OF THE INVENTION

FIGS. 1 and 2 illustrate a known type of vacuum cleaner tool 1. The tool 1 comprises a nozzle 2 having an elongate suction opening 3, and a strip of the bristles 4 that protrude through the suction opening 3. The tool 1 is intended to be swept from side-to-side in directions normal to the suction opening 3. As the tool 1 is swept forwards, the bristles 4 bend backwards and contact the trailing edge of the nozzle 2. The suction opening 3 is therefore located in front of the bristles 4 irrespective of the direction of travel.

A problem with the tool 1 is that the bristles 4 must be relatively stiff in order to avoid the bristles 4 being drawn up into the nozzle 2. The disadvantage of stiff bristles is that they are more likely to mark the cleaning surface.

SUMMARY OF THE INVENTION

The present invention provides a tool for a vacuum cleaner, the tool comprising a nozzle and a bristle assembly, wherein an elongate suction opening is provided in a base of the nozzle, the bristle assembly is mounted within the nozzle and comprises a carrier to which a strip of bristles is attached, the carrier pivots or flexes relative to the nozzle and comprises a pair of wings located on opposite sides of the bristles, and the bristles protrude beyond the carrier by a distance no greater than the width of each wing.

The bristles that protrude beyond the carrier therefore have a length that is smaller than the width of the wings. As a result, is not possible for the bristles to be drawn up into the suction opening. In particular, the wings prevent the bristles from being drawn up into the suction opening. As a result, relatively fine and soft bristles may be used. By attaching the bristles to a carrier that pivots or flexes, the bristles are required to bend through a smaller angle. The bristles are therefore subjected to smaller stresses, thus improving the longevity of the bristles. Additionally, the bristles are better able to retain their shape.

The suction opening may be delimited along its length by a first edge and a second edge, and the wings may extend outwardly from the bristles towards the first edge and the second edge. The carrier then pivots or flexes such that one of the wings contacts the first edge as the tool is swept forwards and the other of the wings contacts the second edge as the tool is swept backwards over the cleaning surface. By contacting one of the two edges of the nozzle as the tool is swept forwards and backwards, the carrier proves an effective seal against the nozzle. Consequently, the pickup performance of the tool is not compromised by the provision of the carrier.

The base may be curved at a front and at a rear of the nozzle. This then has the advantage that, as the tool is swept forwards and backwards, the tool rocks smoothly over the cleaning surface.

A further suction opening may be provided in a front of the nozzle. As a result, the tool is better able to pick up dirt along edges and at corners of the cleaning surface. The bristles may extend through the further opening. This then has two advantages. First, the length and thus the coverage of the strip of bristles are increased. Second, the bristles are able to penetrate edges and corners of the cleaning surface and thus agitate trapped dirt.

Each wing may include a winglet that extends upwardly from a tip of the wing. The winglet helps to straighten the airflow drawn through the suction opening and thus reduce turbulence. As a result, less noise is generated by the airflow as it is drawn through the tool.

A protective pad may be secured to the base of the nozzle so as to surround at least part of the suction opening. Additionally or alternatively, a protective pad may be secured to each wing. The protective pad is softer and/or has a lower coefficient of friction than that of the nozzle or carrier. This then has the advantage that the tool is less likely to mark the cleaning surface and/or the tool may be swept more smoothly over the cleaning surface.

The bristles may be formed of carbon fibre. A strip of bristles has the advantage that no streaks of dirt are left behind as the tool is swept over the cleaning surface. Carbon fibre has at least two advantages. First, carbon fibre allows for relatively soft and fine bristles to be used, which help reduce marking of the cleaning surface. Second, carbon fibre has good anti-static properties, which means that the bristles can be swept over the cleaning surface without charging the surface. In contrast, nylon bristles tend to charge the cleaning surface and the resulting static then acts to attract dirt.

The present invention also provides a tool for a vacuum cleaner, the tool comprising a nozzle and a bristle assembly, wherein an elongate suction opening is provided in a base of the nozzle, the suction opening is delimited along its length by a first edge and a second edge, the bristle assembly is mounted within the nozzle and comprises a carrier to which a strip of bristles is attached, the carrier comprises a pair of wings located on opposite sides of the bristles, the wings extend outwardly from the bristles towards the first edge and the second edge, and the carrier pivots or flexes relative to the nozzle such that one of the wings contacts the first edge as the tool is swept forwards and the other of the wings contacts the second edge as the tool is swept backwards over the cleaning surface.

By attaching the bristles to a carrier that pivots or flexes, the bristles are required to bend through a smaller angle. The bristles are therefore subjected to smaller stresses, thus improving the longevity of the bristles. Additionally, the bristles are better able to retain their shape. The wings may also help to prevent the bristles from being drawn up into the suction opening. By contacting one of the two edges of the nozzle as the tool is swept forwards and backwards, the carrier proves an effective seal against the nozzle. Consequently, the pickup performance of the tool is not compromised by the provision of the carrier.

The present invention further provides a tool for a vacuum cleaner, the tool comprising a nozzle and a bristle assembly, wherein an elongate suction opening is provided in a base of the nozzle, the suction opening is delimited along its length by a first edge and a second edge, the bristle assembly is mounted within the nozzle and comprises a carrier to which a strip of bristles is attached, the carrier comprises a pair of wings located on opposite sides of the bristles, the wings extend outwardly from the bristles towards the first edge and the second edge, the carrier pivots or flexes relative to the nozzle such that one of the wings contacts the first edge as the tool is swept forwards and the other of the wings contacts the second edge as the tool is swept backwards over the cleaning surface, the bristles protrude beyond the carrier by a distance no greater than the width of each wing, and the bristles are formed of carbon fibre.

BRIEF DESCRIPTION OF THE DRAWINGS

In order that the present invention may be more readily understood, embodiments of the invention will now be described, by way of example, with reference to the accompanying drawings, in which.

DETAILED DESCRIPTION OF THE INVENTION

Figure 1:
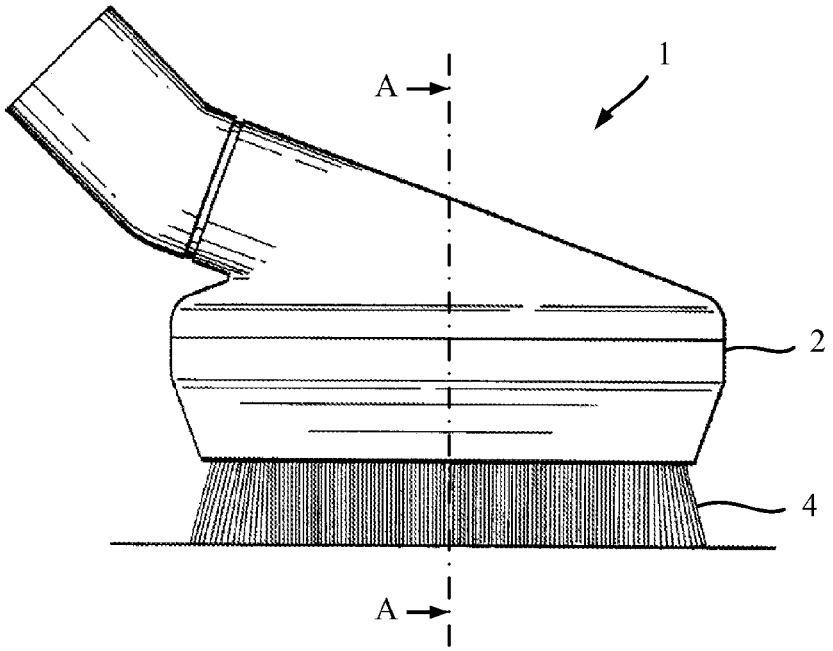
Fig. 1 (Prior Art)
FIG. 1 is a side view of a known type of vacuum cleaner tool.

The vacuum cleaner tool 10 of FIGS. 3 to 8 comprises a nozzle 11, a connecting duct 12, and a bristle assembly 13.

The nozzle 11 is a relatively narrow structure, with the width of the nozzle 11 being much smaller than the length of the nozzle 11. The height of the nozzle 11 tapers (i.e. decreases gradually) from the rear 16 to the front 15 of the nozzle 11, the advantages of which are explained below. The nozzle 11 comprises a suction opening 20 that opens up into an internal cavity 21 within the nozzle 11. The suction opening 20 is located in the base of the nozzle 11 and extends centrally from the front 15 to the rear 16 of the nozzle 11. The suction opening 20 is delimited along its length by two edges 22,23 of the nozzle 11. Each edge 22,23 is raised relative to the lower ends 17,18 of the front 15 and the rear 16 of the nozzle 11. Consequently, when the base of the nozzle 11 is brought into contact with a cleaning surface 40, a gap 25 is created between each of the edges 22,23 and the cleaning surface 40. Again, the advantages of this are explained below.

The connecting duct 12 is attached to the rear 16 of the nozzle 11 and is in fluid communication with the cavity 21 and thus the suction opening 20 of the nozzle 11. The connecting duct 12 is intended to be attached to a hose, wand or the like of a vacuum cleaner (not shown). During use, the vacuum cleaner generates suction at the connecting duct 12, causing air to be drawn in through the suction opening 20.

The bristle assembly 13 is generally planar in shape and comprises a carrier 30 to which a strip of bristles 31 and a spine 32 are attached.

The carrier 30 is formed of a flexible material such as rubber. The bottom of the carrier 30 rises relative to the top in a direction from the rear to the front of the carrier 30. As a result, the height of the carrier 30 tapers (i.e. decreases gradually) from the rear 37 to the front 36 of the carrier 30.

The bristles 31 are formed of carbon fibre and extend beyond the bottom of the carrier 30. The bristles 31 are attached to the carrier 30 by moulding the carrier 30 over the upper ends of the bristles 31. However, the bristles 31 could conceivably be attached to the carrier 30 by other means. The lengths of the bristles 31 taper (i.e. decrease gradually) from the front to the rear of the carrier 30. Consequently, the lengths of the bristles 31 at the rear of the carrier 30 are shorter than those at the front.

The spine 32 is formed of a rigid material, such as hard plastic, and is attached along the top of the carrier 30. The spine 32 provides structural support for the carrier 30, as well as providing means for attaching the bristle assembly 13 to the nozzle 11.

The bristle assembly 13 is mounted within the cavity 21 of the nozzle 11 such that the carrier 30 and the bristles 31 protrude through the suction opening 20. More specifically, the front 15 and the rear 16 of the nozzle 11 each include a recess into which the ends of the spine 32 are secured. The bristle assembly 13 is mounted within the cavity 21 such that the taller part of the carrier 30 and the shorter bristles 31 are located at the rear of the suction opening 20.

The tool 10 is intended to be swept across a cleaning surface 40 in directions normal to the suction opening 20. As the tool 10 is swept forwards, the bristle assembly 13 flexes backwards. The suction opening 20 is then located wholly in front of the bristles 31. The bristles 31 create a partial seal with the cleaning surface 40, which then improves the suction that is generated in front of the bristles 31. As the tool 10 is swept over the cleaning surface 40, the suction generated in front of the bristles 31 causes dirt to be drawn into the cavity 21 of the nozzle 11 via the suction opening 20. Thereafter, the dirt is carried to the vacuum cleaner via the connecting duct 12. The bristles 31 act to pick up much of the dirt that is not drawn into the nozzle 11. The bristles 31 then hold on to the dirt until such time as the dirt is drawn into the nozzle 11, e.g. when the tool 10 is lifted from the cleaning surface 40 or when the direction of travel of the tool 10 is reversed.

Figure 8:
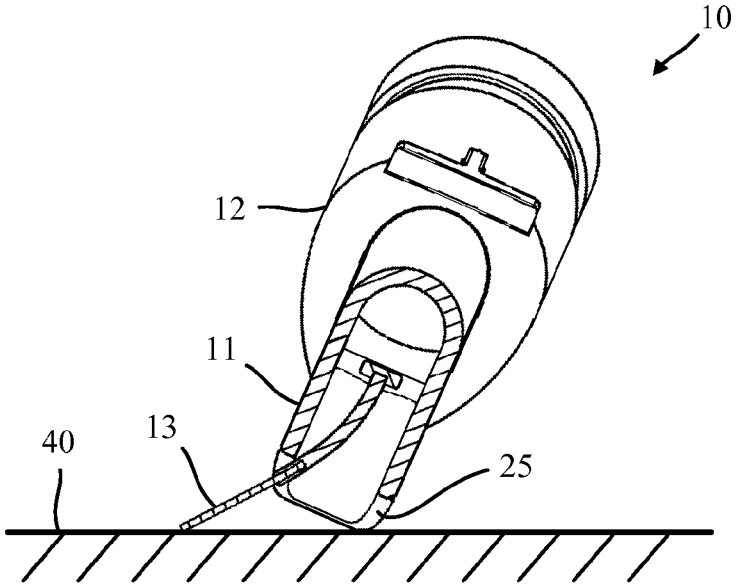
FIG. 8 is a sectional view through the tool of FIG. 3 as the tool is swept across a surface, the section being taken in the plane B-B.
Figure 9:
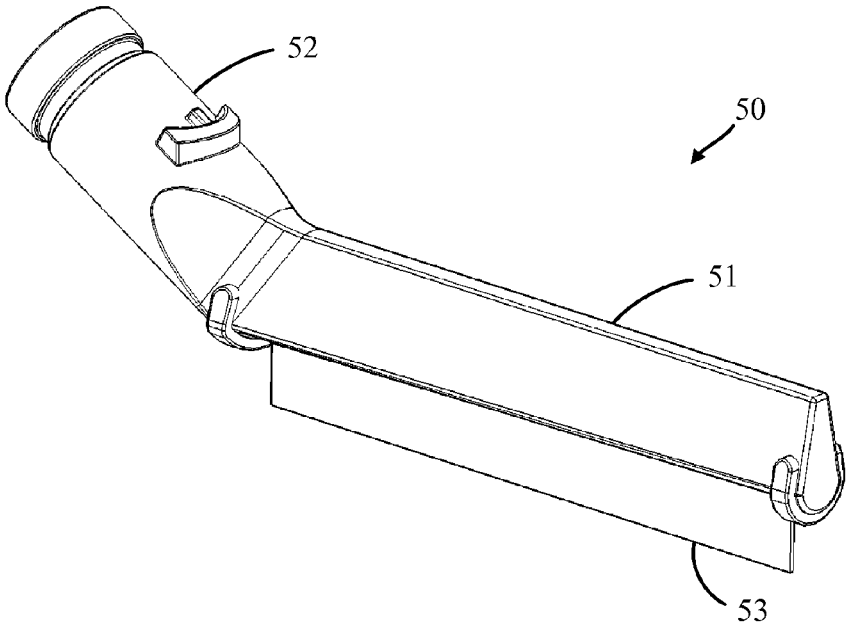
FIG. 9 is a perspective view of a second vacuum cleaner tool.
Figure 10:
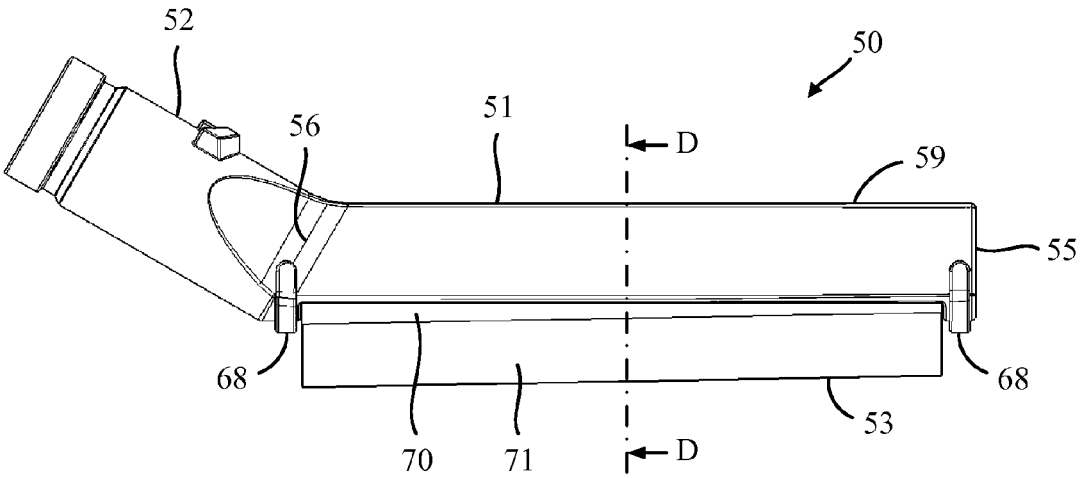
FIG. 10 is a side view of the tool of FIG. 9.
Figure 11:
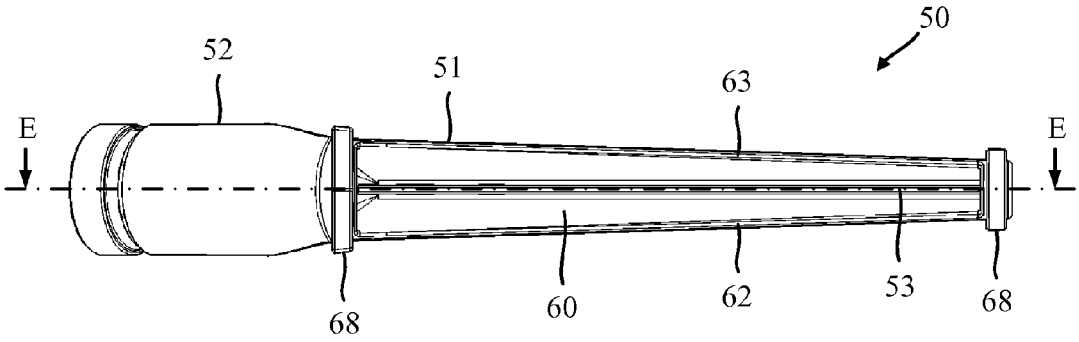
FIG. 11 is an underside view of the tool of FIG. 9.
Figure 12:
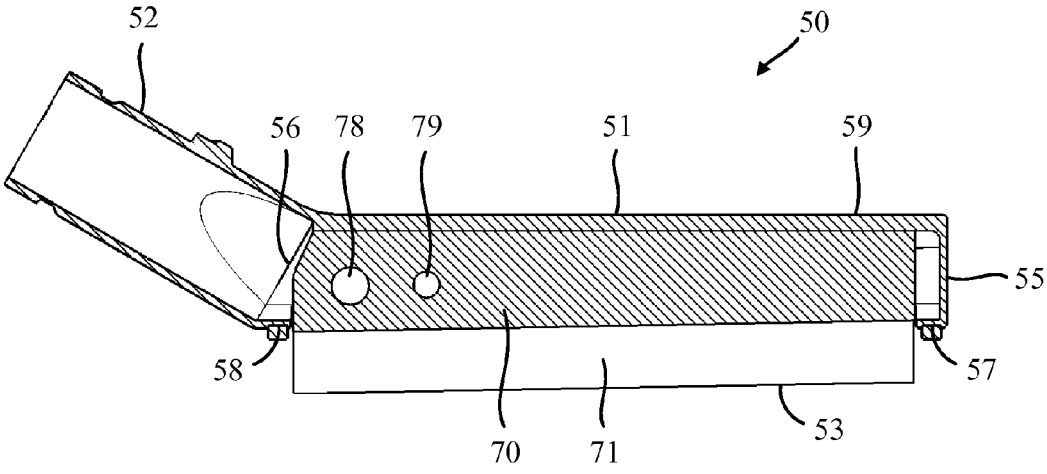
FIG. 12 is a sectional view through the tool of FIG. 9, the section being taken in the plane E-E indicated in FIG. 11.
Figure 13:
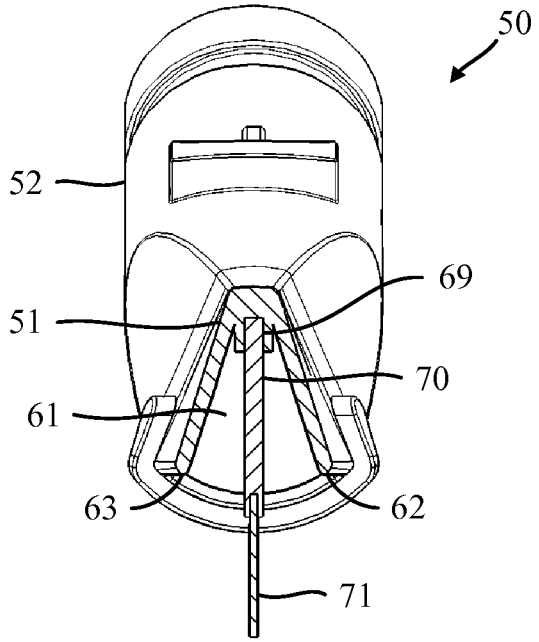
FIG. 13 is a sectional view through the tool of FIG. 9, the section being taken in the plane D-D indicated in FIG. 10.
Figure 14:
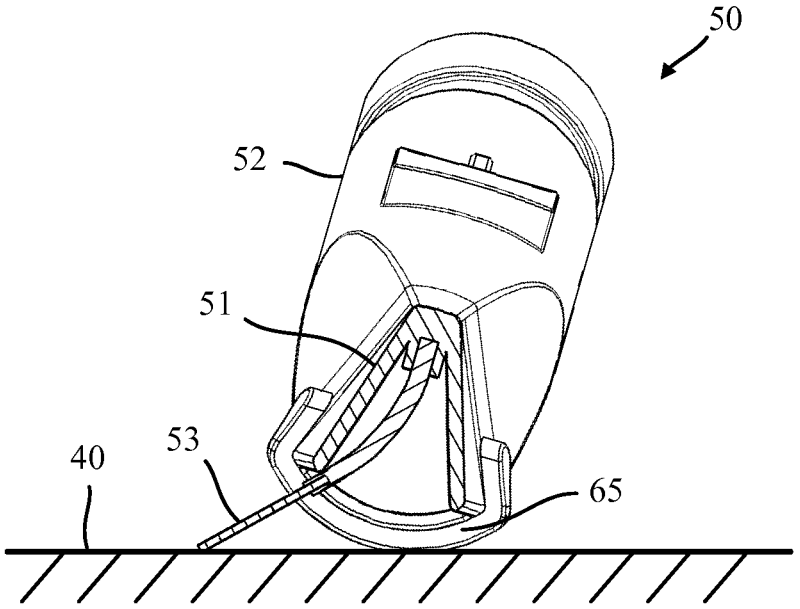
FIG. 14 is a sectional view through the tool of FIG. 9 as the tool is swept across a surface, the section being taken in the plane D-D.
Figure 15:
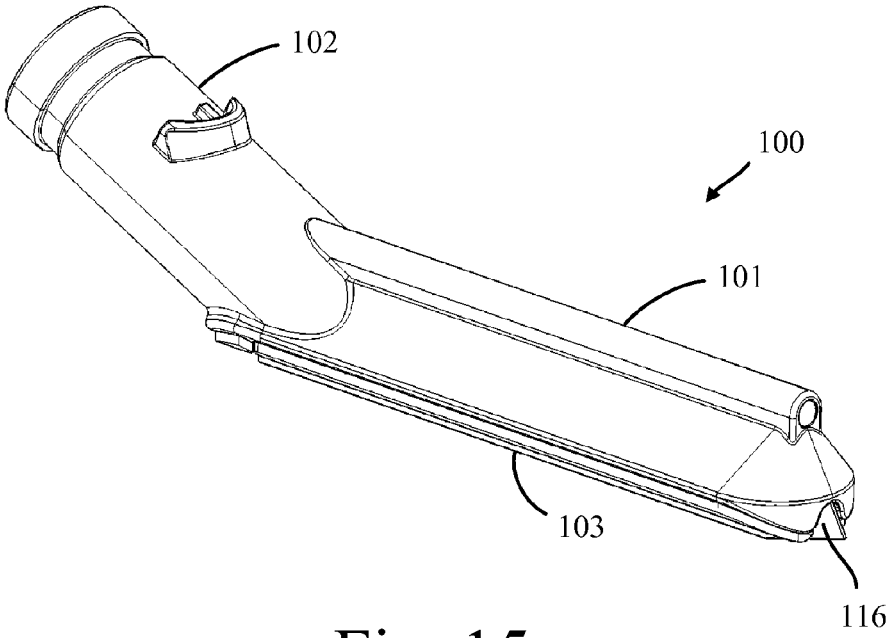
FIG. 15 is a perspective view of a third vacuum cleaner tool.
Figure 16:
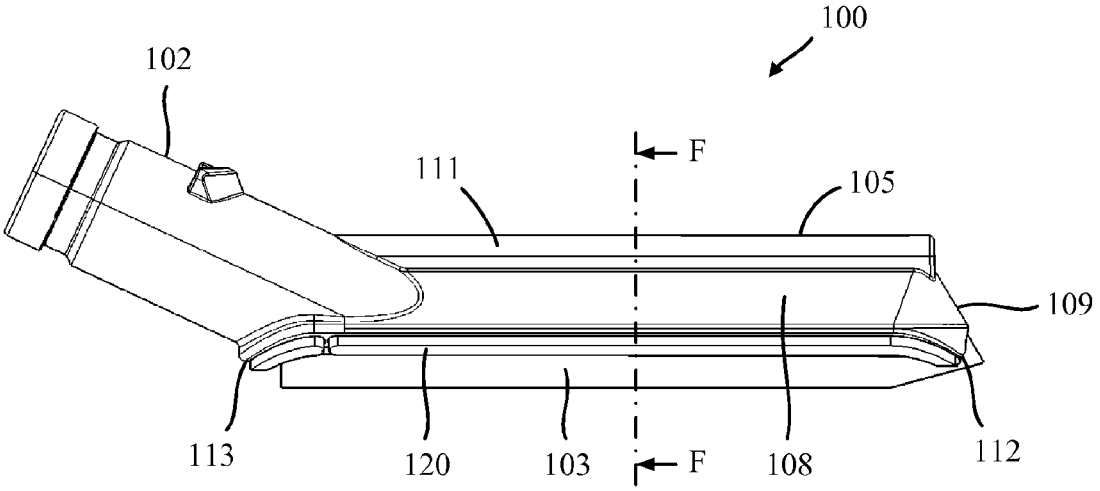
FIG. 16 is a side view of the tool of FIG. 15.
Figure 17:
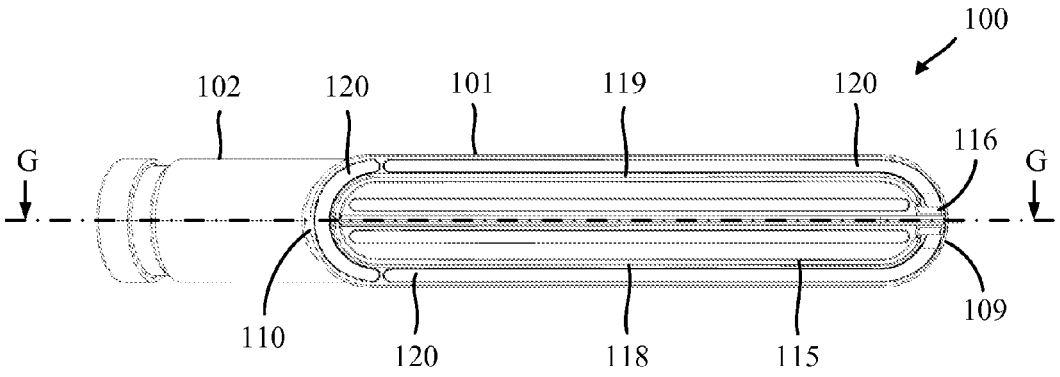
FIG. 17 is an underside view of the tool of FIG. 15.
Figure 18:
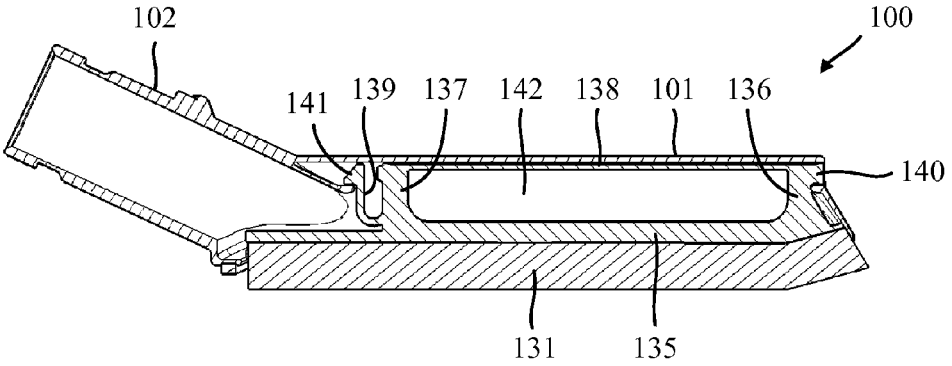
FIG. 18 is a sectional view through the tool of FIG. 15, the section being taken in the plane G-G indicated in FIG. 17.
Figure 19:
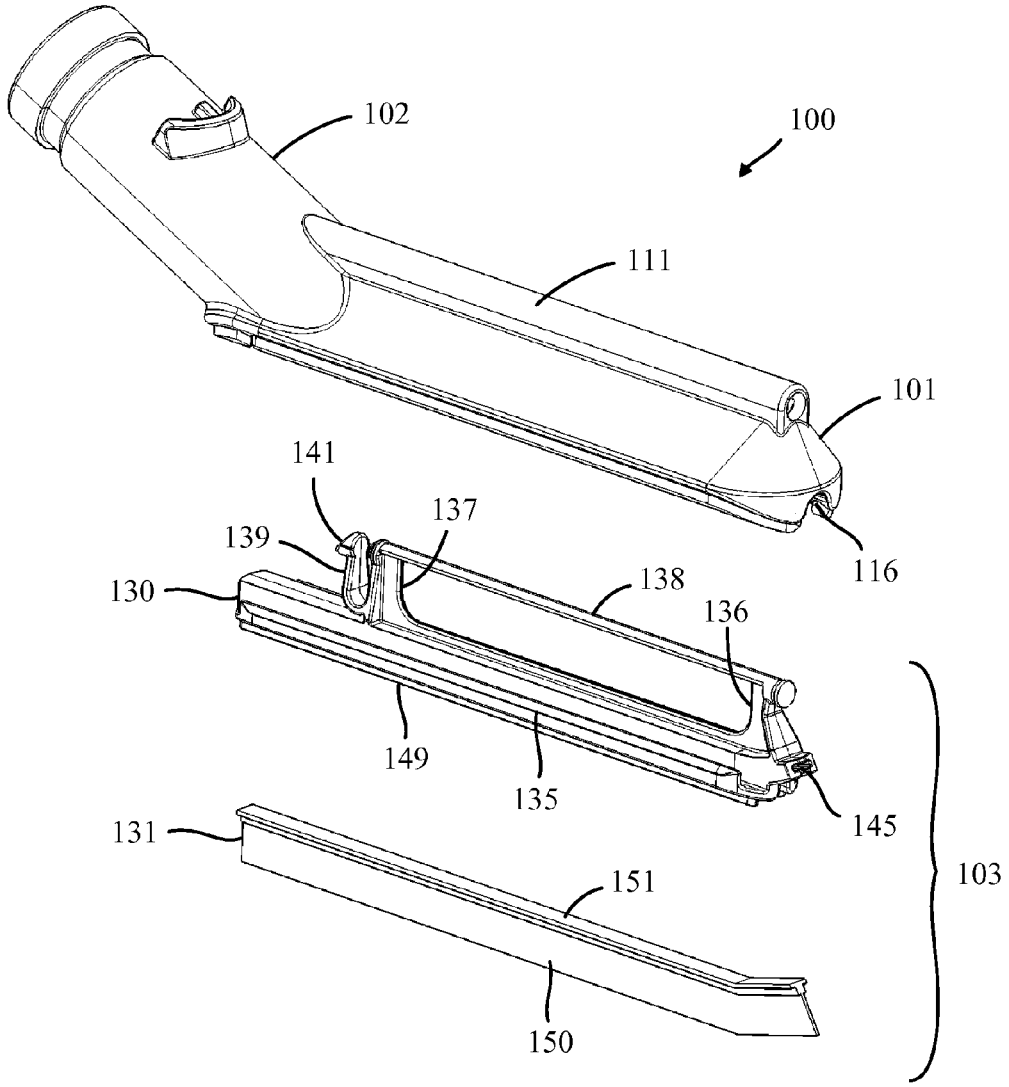
FIG. 19 is an exploded view of the tool of FIG. 15.
Figure 20:
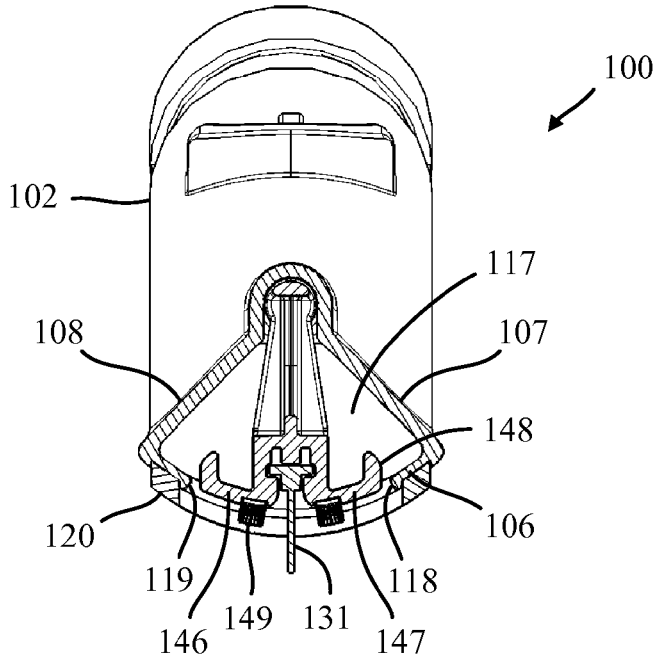
FIG. 20 is a sectional view through the tool of FIG. 15, the section being taken in the plane F-F indicated in FIG. 16.
Figure 21:
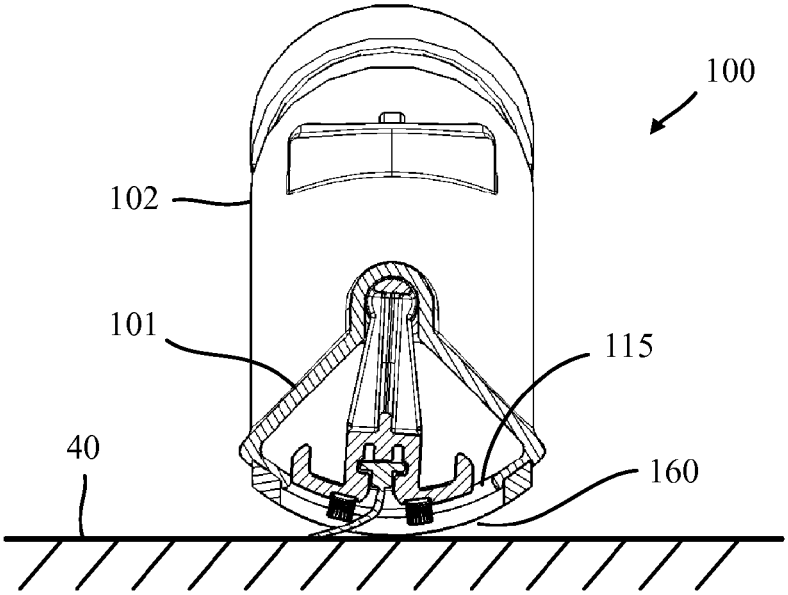
FIG. 21 is a sectional view through the tool of FIG. 15 as the tool is swept across a surface, the section being taken in the plane F-F.

As the tool 10 is swept over the cleaning surface 40, the front 15 and the rear 16 of the nozzle 11 make contact with the cleaning surface 40. Of the two edges 22,23 that delimit the length of the suction opening 20, one defines a leading edge 22 of the nozzle 11 and the other defines a trailing edge 23. Since the two edges 22,23 are raised relative to the front 15 and rear 16 of the nozzle 11, a gap 25 is created between the leading edge 22 of the nozzle 11 and the cleaning surface 40. This gap 25 ensures that, as the tool 10 is swept over the cleaning surface 40, dirt is able to pass under the leading edge 22. As a result, the tool 10 does not push the dirt over the cleaning surface 40. During use, a user will typically tilt the tool 10 in the direction of travel such that an acute angle is formed between the nozzle 11 and the cleaning surface 40, as shown in FIG. 8. As a consequence of tilting the nozzle 11, the leading edge 22 is brought closer to the cleaning surface 40. Nevertheless, the gap 25 between the leading edge 22 and the cleaning surface 40 is maintained. As the tool 10 is tilted further forwards, the gap 25 between the leading edge 22 and the cleaning surface 40 decreases. Eventually, with sufficient tilting, the leading edge 22 may contact the cleaning surface 40. At this stage, the nozzle 11 would then start to push dirt along the cleaning surface 40. This problem may be mitigated by further raising the edges 22,23 of the nozzle 11 such that a larger nominal gap 25 is created between the leading edge 22 and the cleaning surface 40. However, a larger gap 25 has the disadvantage that more air is likely to be pulled in from the region above the cleaning surface 40 rather than at the cleaning surface 40 and thus pickup performance is adversely affected. The edges 22,23 are therefore raised by an amount which seeks to balance the need to maintain a relatively small gap 25 with the need to maintain a gap 25 over the range of angles through which the tool 10 is likely to be used.

The spine 32 provides structural support along the top 35 of the carrier 30. This then helps prevent the carrier 30 from flexing upwards during use of the tool 10, e.g. as a result of the suction generated within the nozzle 11 or when the tool 10 is swept over an uneven surface.

Employing a strip of bristles 31 has the advantage that streaks of dirt are not left behind as the tool 10 is swept over the cleaning surface 40. The choice of carbon fibre has at least two advantages. First, carbon fibre enables relatively soft and fine bristles 31 to be used, which then helps to reduce marking of the cleaning surface 40. Second, carbon fibre has good anti-static properties. Consequently, as the bristles 31 are swept over the cleaning surface 40, the bristles 31 do not charge the cleaning surface 40. In contrast, nylon bristles tend to charge the cleaning surface, and the resulting static then acts to attract dirt to the cleaning surface.

Although advantageous, employing soft, fine bristles is not without its difficulties. In particular, if such bristles were employed with the tool 1 of FIGS. 1 and 2, the suction generated at the suction opening 3 would most likely to draw the bristles 4 into the nozzle 2. The tool 10 of FIGS. 3 to 8 has several features that help to prevent this from happening.

First, the lengths of the bristles 31 taper from the front to the rear of the suction opening 20. Consequently, the bristles 31 at the rear of the suction opening 20 are shorter than those at the front. Longer bristles have the advantage that they are more flexible and thus less likely to mark the cleaning surface 40. Additionally, longer bristles are better able to penetrate awkward surfaces and thus improve pickup performance. It would therefore be advantageous to employ longer bristles along the full length of the suction opening 20. However, if longer bristles are employed along the full length of the suction opening 20 then the bristles 31 at the rear of the suction opening 20 may be drawn up into the nozzle 10. This is because the suction generated at the suction opening 20 is generally greatest at the rear of the suction opening 20 due to the location of the connecting duct 12. By employing shorter bristles 31 at the rear of the suction opening 20, the bristles 31 are stiffer and thus less likely to be drawn up into the nozzle 11. Conversely, by employing longer bristles 31 at the front of the suction opening 20, the bristles 31 are better able to penetrate awkward surfaces and thus improve pickup. The suction at the suction opening 20 typically decreases along the length of the suction opening 20. Accordingly, by having bristles 31 that taper in length along the length of the suction opening 20, relatively good pickup may be achieved whilst ensuring that the bristles 31 are of sufficient length to prevent them being drawn into the nozzle 11.

Second, the bristles 31 are attached to a carrier 30 which provides support for the bristles 31. Additionally, the carrier 30 protrudes beyond the suction opening 20. The suction experienced by the bristle assembly 13 decreases markedly just beyond the suction opening 20 owing to the sudden expansion in available volume. Since the carrier 30 protrudes beyond the suction opening 20, the suction experienced by the bristles 31 is much reduced and thus relatively soft and fine bristles may be used. In contrast, with the tool 1 of FIGS. 1 and 2, the bristles 4 are unsupported and extend through the suction opening 3 and into the cavity of the nozzle 2. As a result, the bristles 4 are subjected to higher levels of suction and thus stiffer bristles 4 must be used in order to ensure that the bristles 4 are not drawn into the nozzle 11. The carrier 30 is not of uniform height but is instead taller at the rear of the suction opening 20. As noted in the preceding paragraph, the suction generated at the suction opening 20 is generally greatest at the rear of the suction opening 20. By employing a carrier 30 that is taller at the rear of the suction opening 20, the carrier 30 provides additional rigidity and support to the bristles 31 where it is needed most.

Third, the height of the nozzle 11 tapers from the rear 16 to the front 15 of the nozzle 11. If the nozzle 11 were of uniform height, the suction generated at the suction opening 20 would be much greater at the rear than at the front of the suction opening 20. This follows since the connecting duct 12 is located at the rear of the nozzle 11. The increased suction at the rear of the suction opening 20 might then cause the bristles 31 to be drawn into the nozzle 11. Additionally, the suction and thus the pickup performance at the front of the suction opening 20 would be poorer. By tapering the height of the nozzle 11, the volume of the cavity 21 within the nozzle 11 also tapers from the rear 16 to the front 15 of the nozzle 11. A larger open volume is therefore created within the nozzle 11 at the rear of the suction opening 20, and a smaller open volume is created at the front of the suction opening 20. The suction is therefore better balanced along the length of the suction opening 20. As result, softer, finer bristles may be used at the rear of the suction opening 20, and the pickup performance at the front of the suction opening 20 may be improved.

Figure 2:
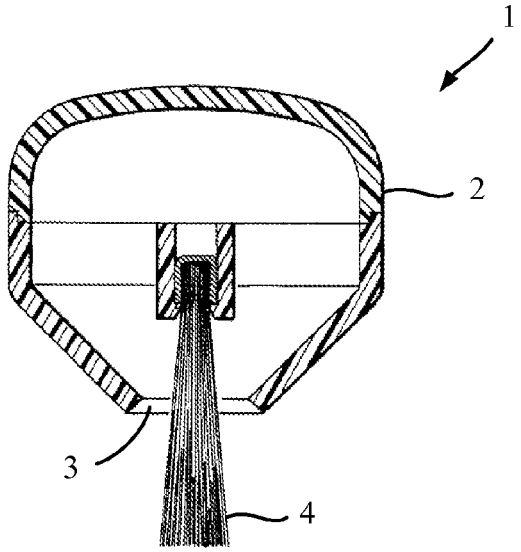
Fig. 2 (Prior Art)
FIG. 2 is a sectional view through the tool of FIG. 1, the section being taken in the plane A-A.
Figure 3:
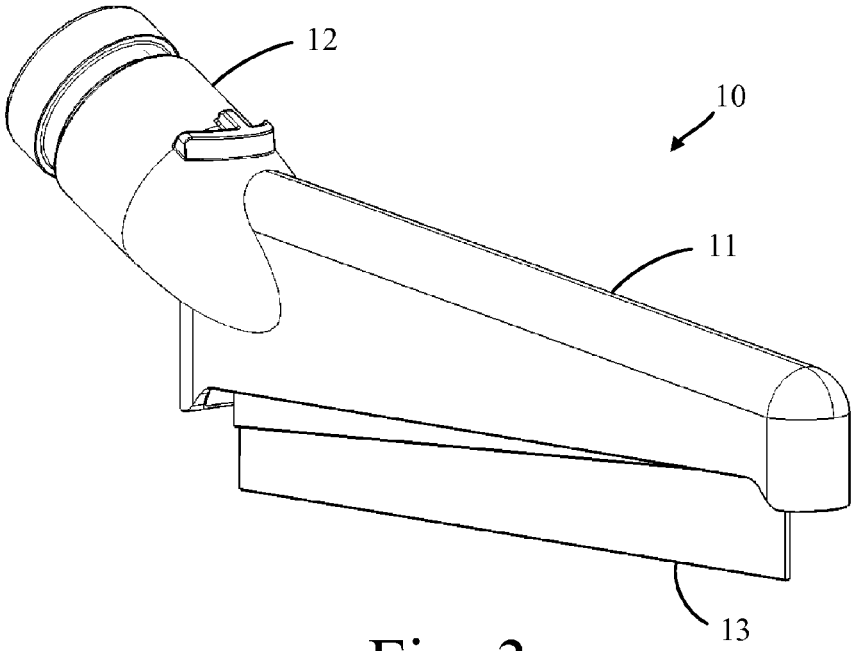
FIG. 3 is a perspective view of a first vacuum cleaner tool.
Figure 4:
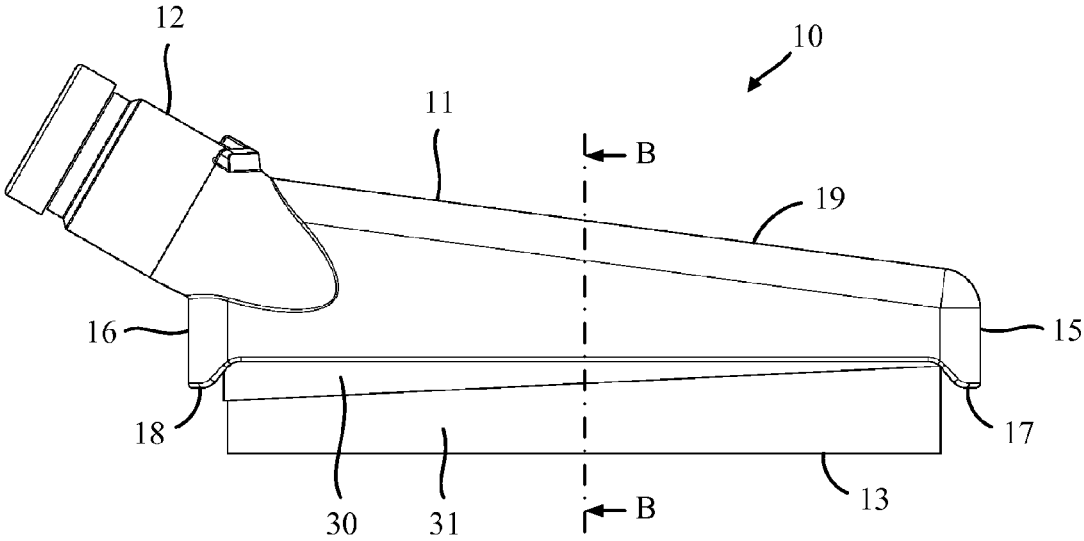
FIG. 4 is a side view of the tool of FIG. 3.
Figure 5:
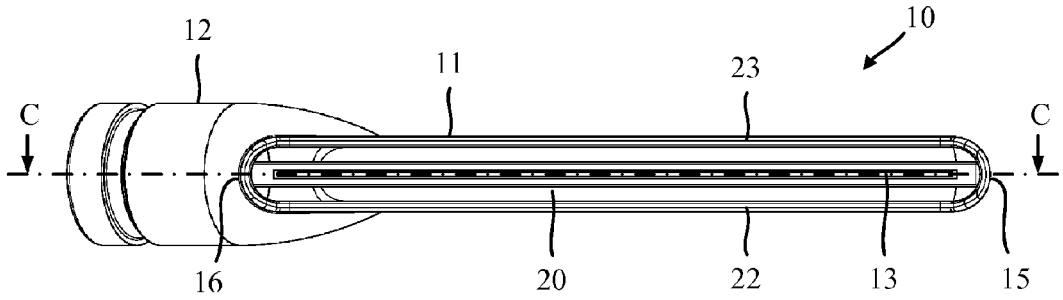
FIG. 5 is an underside view of the tool of FIG. 3.
Figure 6:
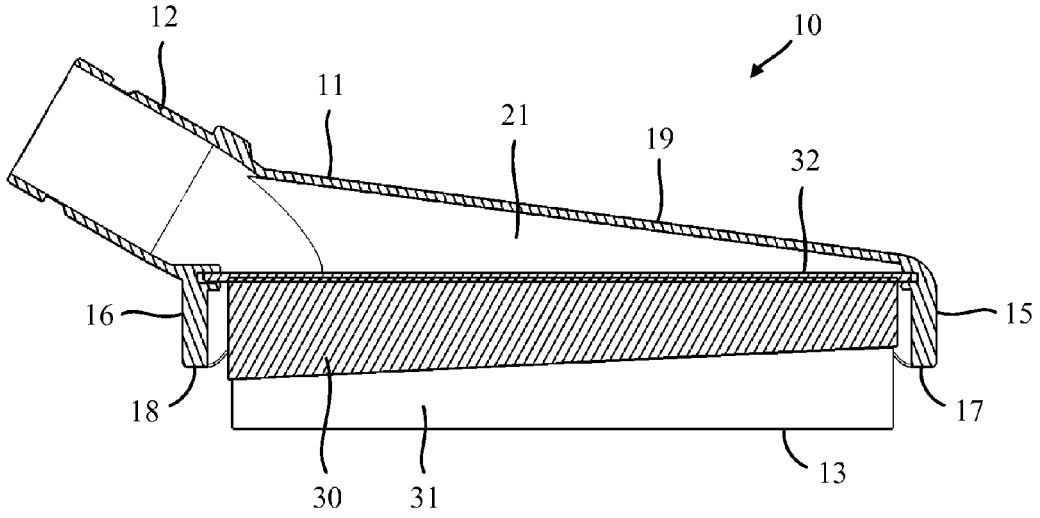
FIG. 6 is a sectional view through the tool of FIG. 3, the section being taken in the plane C-C indicated in FIG. 5.
Figure 7:
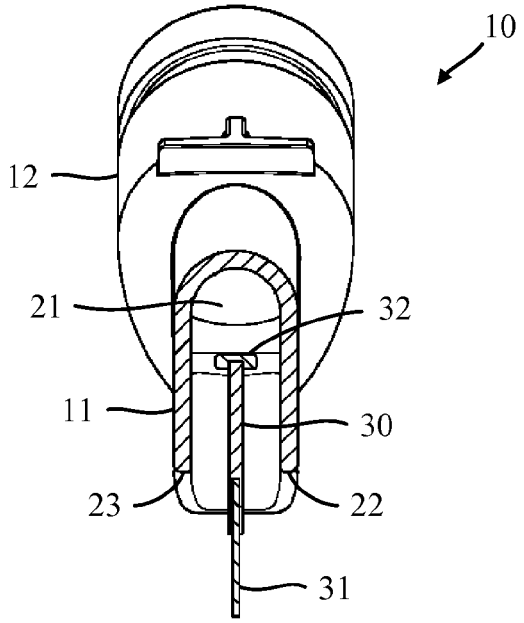
FIG. 7 is a sectional view through the tool of FIG. 3, the section being taken in the plane B-B indicated in FIG. 4.

The carrier 30, being formed of a flexible material, flexes relative to the nozzle 11 as the tool 10 is swept over the cleaning surface 40. As a result, the bristles 31 are required to bend through a smaller angle. The bristles 31 are therefore subjected to smaller stresses, thus improving the longevity of the bristles 31. Additionally, the bristles 31 are better able to retain their shape. In contrast, the bristles 4 of the tool 1 of FIGS. 1 and 2 are subjected to higher bending stresses. Rather than employing a flexible carrier 30, the bristle assembly 13 could conceivably comprise a carrier formed of a rigid material. The bristle assembly 13 might then be pivotally attached to the nozzle 11, and a spring mechanism could be used to ensure that the carrier returns to a central position when the tool 10 is lifted from the cleaning surface 40. Nevertheless, a flexible carrier 30 has the advantage that the resilience is provided by the carrier 30 itself. As a result, a spring-loaded pivot can be avoided, thereby reducing the cost and/or simplifying the assembly of the tool 10.

The carrier 30 protrudes beyond the suction opening 20 by an amount that ensures that, when the bristle assembly 13 is swept backwards (e.g. during a forward sweep of the tool 10), the carrier 30 contacts the trailing edge 23. More specifically, the carrier 30 contacts the trailing edge 23 along the full length of the carrier 30. By contacting the trailing edge 23, the carrier 30 provides a better seal against the trailing edge 23 of the nozzle 11 than would otherwise be possible with the bristles 31. Consequently, less air is pulled in through the trailing side of the tool 10 and thus more suction is generated in front of the bristles 31, thereby improving pickup.

FIGS. 9 to 14 illustrate an alternative vacuum cleaner tool 50 that is similar in many respects to that described above and illustrated in FIGS. 3 to 8. In particular, the tool 50 comprises a nozzle 51, a connecting duct 52, and a bristle assembly 53.

The nozzle 51 is somewhat different in shape to that of FIGS. 3 to 8. The nozzle 11 of FIGS. 3 to 8 has a cross-sectional shape that is generally rectangular. In contrast, the cross-sectional shape of the nozzle 51 of FIGS. 9 to 14 is generally triangular. Accordingly, the shape of the nozzle 51 may be regarded as an elongate prism. The width of the nozzle 11 of FIGS. 3 to 8 is constant along the length of the nozzle 11, whilst the height of the nozzle 11 tapers from the rear 16 to the front 15 of the nozzle 11. In contrast, the height of the nozzle 51 of FIGS. 9 to 14 is constant, and the width of the nozzle 51 tapers (i.e. decreases gradually) from the rear 56 to the front 55 of the nozzle 51.

The nozzle 51, like that of FIGS. 3 to 8, comprises a suction opening 60 that opens up into an internal cavity 61 within the nozzle 51. The suction opening 60 is again located in the base of the nozzle 61 and extends centrally from the front 55 to the rear 56 of the nozzle 51. In contrast to the nozzle 11 of FIGS. 3 to 8, the suction opening 60 is not of uniform width. Instead, the width of the suction opening 60 tapers (i.e. decreases gradually) from the rear to the front of the suction opening 60, the benefits of which are explained below. The suction opening 60 is again delimited along its length by two edges 62,63 of the nozzle 51 that are raised relative to the front 55 and the rear 56 of the nozzle 51. Consequently, when the base of the nozzle 51 is brought into contact with the cleaning surface 40, a gap 65 is created between the leading edge 62 and the cleaning surface 40. The lower ends 57,58 of the front 55 and rear 56 of the nozzle 51 are curved. Furthermore, the lower ends 57,58 are each covered with a protective pad 68 formed of a tufted fabric, the benefits of which are explained below.

The connecting duct 52 is essentially unchanged from that of FIGS. 3 to 8. In particular, the connecting duct 52 is attached to the rear 56 of the nozzle 51 and is intended to be attached to a hose, wand or the like of a vacuum cleaner (again, not shown).

The bristle assembly 53 is again generally planar in shape and comprises a carrier 70 to which a strip of bristles 71 is attached.

The carrier 70 is formed of a flexible material, such as rubber, and the bottom of the carrier 70 rises relative to the top in a direction from the rear to the front of the carrier 70. As a result, the height of the carrier 70 again tapers from the rear to the front of the carrier 70. In contrast to the carrier 30 of FIGS. 3 to 8, the carrier 70 comprises a pair of through-holes 78,79 located towards the rear of the carrier 70. The through-holes 78,79 have different sizes, with the through-hole 78 closest to the rear of the carrier 70 being larger.

The bristles 71 are again formed of carbon fibre and extend beyond the bottom of the carrier 70. However, unlike the bristles 31 of FIGS. 3 to 8, the lengths of the bristles 71 do not taper. Instead, the lengths of the bristles 71 are constant from the rear to the front of the carrier 70.

The bristle assembly 53 is mounted within the cavity 61 of the nozzle 51 such that the carrier 70 and the bristles 71 protrude through the suction opening 60. In contrast, to the bristle assembly 13 of FIGS. 3 to 8 which is attached to the front 15 and rear 16 of the nozzle 11, the bristle assembly 71 of FIGS. 9 to 14 is attached to the top 59 of the nozzle 51. In particular, the top of the carrier 70 is secured (e.g. by means of an adhesive) within a groove 69 formed along the top 59 of the nozzle 51. The bristle assembly 13 of FIGS. 3 to 8 includes a spine 32 that provides structural support along the top 35 of the carrier 30. Since the bristle assembly 53 of FIGS. 9 to 14 is attached along the top 59 of the nozzle 51, the spine may be omitted and the top 59 of the nozzle 51 may provide the necessary support. That being said, there may be advantages in employing a spine. For example, the bristle assembly 53 may comprise a spine that snaps into a groove in the top 59 of the nozzle 51. This then has the potential advantage of simplifying the assembly of the tool 50. In particular, the use of an adhesive to secure the bristle assembly 53 to the nozzle 51 may be avoided.

With the tool 10 of FIGS. 3 to 8, the bristle assembly 13 protrudes beyond the suction opening 20 by an amount that is constant along the length of the suction opening 20. In contrast, with the tool 50 of FIGS. 9 to 14, the amount by which the bristle assembly 53 protrudes beyond the suction opening 60 tapers (i.e. decreases gradually) from the rear to the front of the suction opening 60. Consequently, the amount by which the bristle assembly 53 protrudes beyond the suction opening 60 is greater at the rear of the suction opening 60 than at the front of the suction opening 60.

The tool 50 of FIGS. 9 to 14 is intended to be used in exactly the same way as that described above in connection with the tool 10 of FIGS. 3 to 8. In particular, the tool 50 is intended to be swept across the cleaning surface 40 in directions normal to the suction opening 60. As the tool 50 is swept forwards, the bristle assembly 53 flexes backwards such that the suction opening 60 is located wholly in front of the bristles 71. The bristle assembly 53 contacts the cleaning surface 40 and the trailing edge 63 of the nozzle 51 so as to create a seal behind the suction opening 60.

As the tool 50 is swept over the cleaning surface 40, the front 55 and the rear 56 of the nozzle 51 make contact with the cleaning surface 40. Since the leading and trailing edges 62,63 of the nozzle 51 are raised relative to the front 55 and rear 56, a gap 65 is again created between the leading edge 62 and the cleaning surface 40, thus ensuring that dirt is free to pass under the leading edge 62.

The angle formed between the tool 50 and the cleaning surface 40 typically changes as the tool 50 is swept across the cleaning surface 40. For example, the user may start with the tool 50 at an acute angle relative to the cleaning surface 40. As the tool 50 is swept across the cleaning surface 40, the tool 50 gradually straightens, perhaps finishing at an obtuse angle. The lower ends 57,58 of the nozzle 51 that contact the cleaning surface 40 are curved. This then has the advantage that, as the angle of the tool 50 changes, the lower ends 57,58 of the nozzle 51 rock over the cleaning surface 40 so as to provide a smooth transition. Moreover, the lower ends 57,58 of the nozzle 51 are each covered with a protective pad 68. This has two benefits. First, the pads 68 have a lower coefficient of friction than that of the nozzle 51 and thus the tool 60 may be swept over the cleaning surface 40 more smoothly and with less effort. Second, the pads 68 are softer than the nozzle 51 and thus the tool 60 is less likely to mark the cleaning surface 40. In the present embodiment, the pads 68 are each formed of a tufted fabric. However, the pads 68 might equally be formed of a different material that is softer and has a lower coefficient of friction than that of the nozzle 51. By way of example only, the pads 68 may be formed of a felted fabric, an elastomeric foam perhaps having a low-friction coating such as PTFE, or a strip of very short and fine bristles.

As with the tool 10 of FIGS. 3 to 8, the tool 50 of FIGS. 9 to 14 has several features that help prevent the bristles 71 from being drawn into the nozzle 51.

First, the bristles 71 are again attached to a carrier 70, which provides support for the bristles 71. As with the tool 10 of FIGS. 3 to 8, the connecting duct 52 is attached to the rear 56 of the nozzle 51 and thus the suction is generally greatest at the rear of the suction opening 60. The carrier 70 is again taller at the rear of the suction opening 60. As a result, the carrier 70 provides additional rigidity and support to the bristles 71 where it is needed most. The carrier 70 also protrudes beyond the suction opening 60, and thus the suction experienced by the bristles 71 is much reduced.

Second, the width of the suction opening 60 tapers from the rear to the front of the suction opening 60. If the width of the suction opening 60 were uniform, the suction at the rear of the suction opening 60 would be significantly higher than that at the front of the suction opening 60. The higher level of suction at the rear may cause the bristles 71 to be drawn into the nozzle 51. By employing a suction opening 60 that is wider at the rear and narrower at the front, the suction along the length of the suction opening 60 is better balanced. In particular, the suction at the rear of the suction opening 60 is reduced so as to prevent the bristles 71 being drawn into the nozzle 51, whilst the suction at the front of the suction opening 60 is increased so as to improve pickup.

Third, the width of the nozzle 51 tapers from the rear 56 to the front 55 of the nozzle 51. This has the same benefit as tapering the height of the nozzle 11 of FIGS. 3 to 8, namely that the volume of the cavity 61 within the nozzle 51 decreases from the rear 56 to the front 55 of the nozzle 51. A larger open volume is therefore created within the nozzle 51 at the rear of the suction opening 60, and a smaller open volume is created at the front of the suction opening 60. The suction is therefore better balanced along the length of the suction opening 60. As result, softer, finer bristles 71 may be used at the rear of the suction opening 60, whilst the pickup performance at the front of the suction opening 60 may be improved. Tapering the width rather than the height of the nozzle 51 has the additional benefit that a relatively low profile may be achieved for the tool 50. In particular, the height of the tool may be kept relatively low and the required change in the volume of the cavity 61 may be achieved through changes in the width of the nozzle 51. As a result, the tool 51 may be used to clean under spaces of relatively low height.

As with the tool 10 of FIGS. 3 to 8, the carrier 70 protrudes beyond the suction opening 60 by an amount that ensures that, when the bristle assembly 53 is swept backwards (e.g. during a forward sweep of the tool 50), the carrier 70 contacts the trailing edge 63 of the nozzle 51. As noted above, this then ensures that a better seal is formed between the bristle assembly 53 and the trailing edge 63 of the nozzle 51. The width of the suction opening 60 tapers from the rear 56 to the front 55 of the nozzle 51. Accordingly, in order that the carrier 70 contacts the trailing edge 63 along the full length of the carrier 70, the amount by which the carrier 70 protrudes beyond the suction opening 60 also tapers from the rear to the front. The bristles 71, however, do not taper but are instead of constant length. This then has the advantage that longer bristles may be employed at the rear of the suction opening 60. Additionally, bristles of constant length ensure that, when the bristle assembly 53 is swept backwards and the carrier 70 contacts the trailing edge 63, the bristles 71 extend beyond the trailing edge 63 by an amount that is constant along the length of the trailing edge 63. This then has the benefit of providing more even pickup along the length of the nozzle 51. Since the height of the carrier 70 tapers but the lengths of the bristles 71 are constant, the bristle assembly 53 protrudes beyond the suction opening 60 by an amount that tapers from the rear to the front of the suction opening 60. This is in contrast to the tool 10 of FIGS. 3 to 8, in which the bristle assembly 13 protrudes by the same amount along the length of the suction opening 20.

With the tool 10 of FIGS. 3 to 8, a gap is created directly above the bristle assembly 13, i.e. between the spine 32 and the top 19 of the nozzle 11. This is perhaps best seen in FIGS. 6 to 8. Conceivably, fluff and other dirt drawn into the nozzle 11 may become trapped within this gap. With the tool 50 of FIGS. 9 to 14, on the other hand, the bristle assembly 53 is attached to the top 59 of the nozzle 51. Consequently, fluff and other dirt are prevented from becoming trapped between the bristle assembly 53 and the top 59 of the nozzle 51.

As the tool 51 is swept forwards over the cleaning surface 40, the bristle assembly 53 is swept backwards and contacts the trailing edge 63 of the nozzle 51. A seal is then created between the bristle assembly 53 and the trailing edge 63. The suction generated within the cavity 61 creates a partial vacuum on the trailing side of the bristle assembly 53. Since the suction opening 60 is typically open to ambient, the pressure on the leading side of the bristle assembly 53 is generally higher. Without the through-holes 78,79 in the carrier 70, the difference in pressure on the two sides of the bristle assembly 53 may be sufficiently large that the bristle assembly 53 is forced stuck against the trailing edge 63. Consequently, when the tool 50 is lifted from the cleaning surface 40 in order to reverse the direction of travel, the bristle assembly 53 fails to return to the centre of the suction opening 60. The through-holes 78,79 in the carrier 70 prevent this from happening. The through-holes 78,79 provide a passageway between the leading side and the trailing side of the bristle assembly 53. The through-holes 78,79 thus act to better equalise the pressure on the two sides of the bristle assembly 53. The through-holes do not necessarily result in perfect equalisation. However, the through-holes 78,79 ensure that the pressure difference is not excessive. Consequently, when the tool 50 is lifted from the cleaning surface 40, the resilience of the carrier 70 is sufficient to overcome the pressure difference and return the bristles assembly 53 to the centre of the suction opening 60.

Any through-holes in the carrier 70 may present a trap for fluff or other dirt. If the through-holes were too small, the through-holes may become blocked altogether. Larger through-holes will naturally reduce the likelihood of the through-holes blocking. However, as the number and sizes of the through-holes increase, the holes will have an increasing influence over the behaviour of the carrier 70. In particular, an excessive number of holes or holes that are excessively large may cause the carrier 70 to flex in an undesired manner. The location, number and sizes of the through-holes 78,79 are therefore selected such that the bristle assembly 53 is prevented from sticking against the trailing edge 63 of the nozzle 51 whilst ensuring that the behaviour of the carrier 70 is not adversely affected.

The through-holes 78,79 are formed in a region of the carrier 70 that is proximate the rear 56 of the nozzle 51. Since the connecting duct 52 is located at the rear 56 of the nozzle 51, the suction within the nozzle 51 is generally greatest at the rear 56 of the nozzle 51. Any pressure difference between the leading side and the trailing side of the bristle assembly 53 is therefore likely to be greatest at the rear 56 of the nozzle 51. By locating the through-holes 78,79 in a region of the carrier 70 proximate the rear 56 of the nozzle 51, the number of through-holes may be kept to a minimum whilst ensuring that adequate equalisation of pressure is achieved.

The through-holes 78,79 in the carrier 70 are of different sizes. In particular, the through-hole 78 closest to the rear 56 of the nozzle 51 is larger. Both through-holes 78,79 are of a size that is intended to make blockage of the holes 78,79 unlikely. By having through-holes 78,79 of different sizes, a larger hole 78 can be used towards the rear of the carrier 70 where the pressure difference between the leading and trailing sides of the bristle assembly 53 is likely to be greatest. Since the pressure difference further along the carrier 70 is likely to be smaller, a smaller hole 79 may be used. As a result, the effect that the through-holes 78,79 have on the behaviour of the carrier 70 can be kept to a minimum whilst ensuring that adequate equalisation of pressure is achieved.

FIGS. 15 to 21 illustrate a further vacuum cleaner tool 100. As with tools 10,50 described above and illustrated in FIGS. 3 to 14, the tool 100 comprises a nozzle 101, a connecting duct 102, and a bristle assembly 103.

The nozzle 101 is elongate in shape, with the length of the nozzle 101 being greater than the height and width. The cross-sectional shape of the nozzle 101 resembles that of a circular sector, with the sides 107,108 of the nozzle 101 forming the two radii and the base 106 of the nozzle 101 forming the arc of the sector. With the tools 10,50 illustrated in FIGS. 3 to 14, the height or width of the nozzle tapers from the rear to the front of the nozzle. In contrast, with the tool 100 illustrated in FIGS. 15 to 21, the nozzle 101 does not taper in height or width. The top 105 of the nozzle 101 includes a cylindrical spine which, as described below, serves to hold the bristle assembly 103.

The nozzle 101 comprises a main suction opening 115 and an auxiliary suction opening 116, each of which opens up into an internal cavity 117 within the nozzle 101. The main suction opening 115 is formed in the base 106 of the nozzle 101 and resembles an elongate oval that extends from the front 109 to the rear 110 of the nozzle 101 and has straight side edges. Since the base 106 of the nozzle 101 is arcuate, the side edges 118,119 of the suction opening 115 are raised relative to the front 109 and the rear 110 of the nozzle 101. Consequently, as with the tools 10,50 illustrated in FIGS. 3 to 14, when the base 106 of the nozzle 101 is brought into contact with the cleaning surface 40, a gap 160 is created between the leading edge 118 and the cleaning surface 40. Protective pads 120 formed of a tufted fabric are secured to the base 106 of the nozzle 101 so as to surround the main suction opening 115. The auxiliary suction opening 116 comprises a notch formed in the front 109 of the nozzle 101. As explained below, the auxiliary suction opening 116 helps to pick up dirt along the edge of a wall or the like as the tool 100 is drawn sideways along the wall.

Like the tools 10,50 described above and illustrated in Figured 3 to 14, the connecting duct 102 is attached to the rear 110 of the nozzle 101 and is in fluid communication with the cavity 117 and thus with the suction openings 115,116 of the nozzle 101. Again, the connecting duct 102 is intended to be attached to a hose, wand or the like of a vacuum cleaner (not shown).

The bristle assembly 103 comprises a carrier 130 to which a strip of bristles 131 is attached.

The carrier 130 is formed of a rigid material and comprises a platform 135, two struts 136,137 that extend upwardly from the platform 135, a beam 138 that extends between the two struts 136,137, a cantilever arm 139, and a pair of lugs 140, 141.

The platform 135 comprises a pair of wings 146,147 that extend along opposite sides of a central channel 145. When viewed from below, the shape of the platform 135 mirrors the main suction opening 115 and thus resembles an elongate oval. Each wing 146,147 is elongate, has a straight side edge and curved front and rear edges. The side edge may be regarded as the tip of the wing 146,147. Each wing 146,147 curves upwardly from the central channel 145 to the tip. As a result, the base of the platform 135 is curved. Moreover, the curvature of the base of the platform 135 mirrors that of the base 106 of the nozzle 101. Each wing 146,147 includes a winglet 148 that extends upwardly from the tip of the wing 146,147. A protective pad 149, again formed of a tufted fabric, is secured along the length of each wing 146,147.

The two struts 136,137 extend upwardly from the top of the platform 135. More specifically, a first strut 136 extends upwardly from a front end of the platform 135, and a second strut 137 extends upwardly from a point partway along the length of the platform 135.

The beam 138 extends between the tops of the two struts 136,137.

The cantilever arm 139 is an L-shaped arm that extends from the rear of the second strut 137. Alternatively, the cantilever arm 139 could be a straight arm that extends upwardly from the top of the platform 135.

A first lug 140 extends outwardly from the first strut 136, and a second lug 141 extends outwardly from the cantilever arm 139. The first lug 140 is cylindrical in shape, whilst the second lug 141 resembles a truncated cylinder, i.e. a cylinder cut by a plane.

As noted above, the nozzle 101 comprises a spine 111 that extends along the top 105 of the nozzle 101. The top of the carrier 130 is then held within this spine 111. The spine 111 comprises a channel and a retaining recess located at each end of the channel. The two lugs 140,141 of the carrier 130 are held within the recesses, whilst the beam 138 of the carrier 130 extends along the channel. During assembly, the first lug 140 is inserted into the recess at the front end of the spine 111. The rear of the carrier 130 is then pushed upwards, causing the second lug 141 to contact the nozzle 101. The second lug 141 has a ramped surface. Consequently, as the carrier 130 continues to be pushed upwards, the cantilever arm 139 is caused to pivot in a direction towards the front 109 of the nozzle 101. With sufficient force, the cantilever arm 139 pivots to enable the second lug 141 to snap-fit into the recess at the rear end of the spine 111.

When the carrier 130 is held within the nozzle 101, the platform 135 acts to cover a large part of the main suction opening 115. Consequently, the main suction opening 115 resembles as oval racetrack that extends around the platform 135. The lugs 140,141 are held within the recesses such that the carrier 130, and thus the bristle assembly 103, is free to pivot relative to the nozzle 101. As the carrier 130 pivots, the platform 135 contacts a side edge 118,119 of the nozzle 101. As a result, pivotal movement of the carrier 130 is relatively limited.

The strip of bristles 131 comprises a row of bristles 150 held together by a spine 151 that extends along the top of the bristles 150. The bristles 150 are formed of carbon fibre and are held together by moulding the spine 151 over the tops of the bristles 150. The strip of bristles 131 is held within the channel 145 of the carrier 130. The bristles 150 then protrude downwardly through the main suction opening 115 in the base 106 of the nozzle 101. The channel 145 rises upwardly at the front of the carrier 130. Consequently, the bristles 150 additionally protrude through the auxiliary suction opening 116 in the front 109 of the nozzle 101.

The tool 100 of FIGS. 15 to 21 is intended to be used in exactly the same way as the tools 10,50 described above and illustrated in FIGS. 3 to 14. In particular, the tool 100 is intended to be swept across the cleaning surface 40 in directions normal to the main suction opening 115. As the tool 100 is swept forwards, the bristle assembly 103 pivots backwards. On pivoting backwards, a wing 146 of the carrier 130 contacts the trailing edge 119 of the nozzle 101 so as to create a seal along the trailing edge 119. As a result, the main suction opening 115 is located primarily between the platform 135 of the bristle assembly 103 and the leading edge 118 of the nozzle 101.

As the tool 100 is swept over the cleaning surface 40, the base 106 of the nozzle 101 contacts the cleaning surface 40 at the front 109 and rear 110. Since the leading and trailing edges 118,119 of the nozzle 101 are raised relative to the front and rear ends 112,113, a gap 160 is again created between the leading edge 118 and the cleaning surface 40, thus ensuring that dirt is free to pass under the leading edge 118. As with the other tools 10,50, the angle formed between the tool 100 and the cleaning surface 40 typically changes as the tool 100 is swept across the cleaning surface 40. Since the base 106 of the nozzle 101 is curved, the front and rear ends 112,113 of the nozzle 101 that contact the cleaning surface 40 are curved. Consequently, as the angle of the tool 100 changes, the front and rear ends 112,113 rock over the cleaning surface 40 so as to provide a smooth transition. The protective pads 120 secured to the base 106 of the nozzle 101 provide the same benefits as that detailed above in connection with the tool 50 of FIGS. 9 to 14, i.e. the tool 100 may be swept more smoothly over the cleaning surface 40, and the tool 100 is less likely to mark the cleaning surface 40. Again, as noted above in connection with the tool 50 of FIGS. 9 to 14, although the protective pads 120 are formed of a tufted fabric, other materials may alternatively be used, e.g. felted fabric, an elastomeric foam having a low-friction coating, or a strip of very short and fine bristles.

The carrier 130 is held within the nozzle 101 such that the platform 135 is raised slightly relative to the base 106 of the nozzle 101. Consequently, when the tool 100 is used on an even surface, the platform 135 does not normally contact the cleaning surface. However, should the tool 100 be used on an uneven surface, or should the front end 112 or rear end 113 of the tool 100 be pushed off the cleaning surface, the platform 135 may contact the cleaning surface. The base of the platform 135 has a curvature that mirrors that of the nozzle 101. Consequently, should the platform 135 contact the cleaning surface 40, it continues to be possible to rock the tool 100 over the cleaning surface 40. The protective pads 149 secured to the platform 135 then provide the same benefits as those secured to the nozzle 101.

The bristles 150 of the tool 100 are relatively short. Indeed, the portion of the bristles 150 that protrudes beyond the platform 135 has a length that is no greater than the width of each wing 146,147. That is to say that the bristles 150 have an effective length (i.e. a length that protrudes beyond the carrier 130) that is smaller than the width of each wing 146,147. Consequently, it is not possible for the bristles 150 to be drawn up into the nozzle 101 via the main suction opening 115.

As air is drawn in through the main suction opening 115, the winglets 148 help to straighten the airflow and thus reduce turbulence. As a result, less noise is generated by the airflow as it is drawn through the tool 100.

The tool 100 of FIGS. 15 to 21 has a number of advantages over the other two tools 10,50 illustrated in FIGS. 3 to 14. The tool 100 generally has improved suction at the front of the main suction opening 115. In spite of the tapered height or width of the nozzle, the tools 1,50 of FIGS. 3 to 14 may experience relatively poor suction at the front of the suction opening. In comparison to the tools 1,50 of FIGS. 3 to 14, the tool 100 of FIGS. 15 to 21 has a smaller suction opening 115, which is to say that the surface area of the suction opening 115 is smaller. Consequently, the suction around the suction opening 115 is better balanced and thus the suction at the front of the suction opening 115 is increased. However, simply reducing the size of the suction opening does not necessarily result in improved suction at the front of the suction opening. For example, one might reduce the width of the nozzle 11 of the tool 10 illustrated in FIGS. 3 to 8 in order to achieve a smaller suction opening 20. However, a narrower nozzle 11 would create a constriction at the junction between the nozzle 11 and the connecting duct 12. As a result, the flow of air through the tool 10 would be constricted and thus the suction at the front of the suction opening 20 would actually worsen rather than improve. With the tool 100 of FIGS. 15 to 21, a relatively small suction opening 115 is achieved whilst maintaining a relatively wide and tall nozzle 101. This is made possible by the platform 135 of the carrier 130, which acts to cover a large part of the main suction opening 115. As a result, a constriction in the nozzle 101 is avoided and the suction at the front of the suction opening 115 is improved The tool 100 of FIGS. 15 to 21 has an auxiliary suction opening 116 at the front 109 of the nozzle 101. This then has the benefit of improving dirt pickup along edges of the cleaning surface 40. For example, when using the tool 100 up against a wall or the like, a user is able to abut the front 109 of the tool 100 against the wall and then sweep the tool 100 sideways in a direction parallel to the wall. Dirt that collects at the edge between the cleaning surface and the wall is then be drawn into the nozzle 101 via the auxiliary suction opening 116.

The strip of bristles 131 is secured to the carrier 130 such that the bristles 150 extend through and beyond the auxiliary suction opening 116. This then has two advantages. First, it acts to increase the length and thus the coverage of the strip of bristles 131. Second, it enables the bristles 150 to better penetrate edges and corners. Conceivably, one could also provide an auxiliary suction opening at the rear 110 of the nozzle 101 and the strip of bristles 131 may be secured to the carrier 130 such that the bristles 150 extend through and beyond this additional opening. This would then further extend the length of the strip of bristles 131. However, a notch in the rear 110 of the nozzle 101 is likely to adversely affect the suction at the auxiliary suction opening 116 and at the front of the main suction opening 115.

As with the tool 50 of FIGS. 9 to 14, the bristle assembly 103 is attached to the top 105 of the nozzle 101. The carrier 130 then comprises a through-hole 142 so as to equalise the pressure on the two sides of the bristle assembly 103. However, unlike the tool 50 of FIGS. 9 to 14 which has two relatively small through-holes 78,79, the through-hole 142 in the carrier 130, which is delimited by the platform 135, the two struts 136,137 and the beam 138, is relatively large. Having a relatively large through-hole 142 is made possible because the carrier 130 is formed of a rigid material. A large through-hole 142 has at least two advantages. First, pressure equalisation is improved and therefore the chances of the bristle assembly 103 sticking against the trailing edge 119 of the nozzle are much reduced. Second, the likelihood of dirt blocking the through-hole 142 is reduced. Indeed, with the tool 100 of FIGS. 15 to 21, the height of the through-hole 142 is larger than the width of the main suction opening 115. Consequently, it should not be possible for dirt drawn in through the main suction opening 115 to become trapped in the through-hole 142.

In the embodiment described above, the carrier 130 comprises a beam 138 that extends between the two struts 136, 137. However, the beam 138 offers little technical benefit and may be omitted. Accordingly, in a broader sense, the tools 50, 100 of FIGS. 9 to 21 may be said to comprise a carrier 70,130 that is attached to the top 59,109 of nozzle 51,101, and a passageway(s) 78,79,142 that extends through or over the carrier 70,130. The passageway(s) 78,79,142 extends between the leading side and the trailing side of the bristle assembly 53,103 so as to better equalise the pressure on the two sides of the bristle assembly 53,103.

The invention claimed is:

1. A tool for a vacuum cleaner, the tool comprising a nozzle and a bristle assembly, wherein an elongate suction opening is provided in a base of the nozzle, the bristle assembly is mounted within the nozzle and comprises a carrier to which a strip of bristles is attached, the carrier pivots or flexes relative to the nozzle and comprises a pair of wings located on opposite sides of the bristles, and the bristles protrude beyond the carrier by a distance no greater than the width of each wing.

2. The tool of claim 1, wherein the suction opening is delimited along its length by a first edge and a second edge, the wings extend outwardly from the bristles towards the first edge and the second edge, and the carrier pivots or flexes such that one of the wings contacts the first edge as the tool is swept forwards and the other of the wings contacts the second edge as the tool is swept backwards over the cleaning surface.

3. The tool of claim 1, wherein the base is curved at a front and at a rear of the nozzle.

4. The tool of claim 1, wherein a further suction opening is provided in a front of the nozzle.

5. The tool of claim 4, wherein the bristles protrude through the further opening.

6. The tool of claim 1, wherein each wing includes a winglet that extends upwardly from a tip of the wing.

7. The tool of claim 1, wherein a protective pad is secured to the base of the nozzle so as to surround at least part of the suction opening.

8. The tool of claim 1, wherein a protective pad is secured to the base of each wing.

9. The tool of claim 1, wherein the bristles are formed of carbon fibre.

10. A tool for a vacuum cleaner, the tool comprising a nozzle and a bristle assembly, wherein an elongate suction opening is provided in a base of the nozzle, the suction opening is delimited along its length by a first edge and a second edge, the bristle assembly is mounted within the nozzle and comprises a carrier to which a strip of bristles is attached, the carrier comprises a pair of wings located on opposite sides of the bristles, the wings extend outwardly from the bristles towards the first edge and the second edge, and the carrier pivots or flexes relative to the nozzle such that one of the wings contacts the first edge as the tool is swept forwards and the other of the wings contacts the second edge as the tool is swept backwards over the cleaning surface.

11. The tool of claim 10, wherein the base is curved at a front and at a rear of the nozzle.

12. The tool of claim 10, wherein a further suction opening is provided in a front of the nozzle.

13. The tool of claim 10, wherein each wing includes a winglet that extends upwardly from a tip of the wing.

14. The tool of claim 10, wherein a protective pad is secured to the base of at least one of the nozzle and the wings.

15. The tool of claim 10, wherein the bristles are formed of carbon fibre.

16. A tool for a vacuum cleaner, the tool comprising a nozzle and a bristle assembly, wherein an elongate suction opening is provided in a base of the nozzle, the suction opening is delimited along its length by a first edge and a second edge, the bristle assembly is mounted within the nozzle and comprises a carrier to which a strip of bristles is attached, the carrier comprises a pair of wings located on opposite sides of the bristles, the wings extend outwardly from the bristles towards the first edge and the second edge, the carrier pivots or flexes relative to the nozzle such that one of the wings contacts the first edge as the tool is swept forwards and the other of the wings contacts the second edge as the tool is swept backwards over the cleaning surface, the bristles protrude beyond the carrier by a distance no greater than the width of each wing, and the bristles are formed of carbon fibre.

17. The tool of claim 16, wherein the base is curved at a front and at a rear of the nozzle.

18. The tool of claim 16, wherein a further suction opening is provided in a front of the nozzle.

19. The tool of claim 16, wherein each wing includes a winglet that extends upwardly from a tip of the wing.

20. The tool of claim 16, wherein a protective pad is secured to the base of at least one of the nozzle and the wings.

* * * * *